US007000562B2

(12) United States Patent
Bouquard

(10) Patent No.: US 7,000,562 B2
(45) Date of Patent: Feb. 21, 2006

(54) PNEUMATIC BOAT ARRANGED FOR THE LOADING/UNLOADING AND TRANSPORTATION OF FLOATING LOADS

(75) Inventor: Pascal Bouquard, Issy les Moulineaux (FR)

(73) Assignee: Zodiac International, Issy les Moulineaux (FR)

( * ) Notice: Subject to any disclaimer, the term of this patent is extended or adjusted under 35 U.S.C. 154(b) by 0 days.

(21) Appl. No.: 11/006,955

(22) Filed: Dec. 8, 2004

(65) Prior Publication Data

US 2005/0126467 A1 Jun. 16, 2005

(30) Foreign Application Priority Data

Dec. 12, 2003 (FR) ..... 03 14642

(51) Int. Cl.
*B63B 7/00* (2006.01)

(52) U.S. Cl. ..... 114/345; 441/40

(58) Field of Classification Search ..... 114/345; 441/39, 40

See application file for complete search history.

(56) References Cited

U.S. PATENT DOCUMENTS 926,458 A 6/1909 Beeler et al.
3,937,027 A * 2/1976 Koehler et al. ..... 405/209
4,345,536 A * 8/1982 Gregg ..... 114/124
5,228,407 A * 7/1993 Cummer et al. ..... 114/345

FOREIGN PATENT DOCUMENTS

| | | |
|---|---|---|
| FR | 1301368 | 8/1962 |
| FR | 2754778 | 4/1998 |
| GB | 931210 | 7/1963 |

* cited by examiner

*Primary Examiner*—Jesus D. Sotelo
(74) *Attorney, Agent, or Firm*—Dean W. Russell; Kilpatrick Stockton LLP

(57) ABSTRACT

A semi-rigid pneumatic boat (1) comprising: a rigid hull (2) defined by a rigid underwater hull (3) closed on the top by a rigid floor (4) and bordered on two sides by two pneumatic floats (5); a ballast (8) arranged in the rear part of the rigid hull (2) and pumping means for filling it with water or emptying it thereof; two pneumatic chambers (10) defined in the respective rear parts of the two floats (5) and pneumatically isolated from the rest of the floats; means (12, 13) for inflating and means (14) for deflating the rear chambers; the boat having no rear board; thus, by filling the ballast (8) and by deflating the rear chambers (10) the boat is nosed up, with its rear part submerged and a load (25) may be brought closer, against the floor (4), and then by emptying the ballast and re-inflating the chambers (10) the boat is set afloat, supporting the load (25).

11 Claims, 4 Drawing Sheets

PNEUMATIC BOAT ARRANGED FOR THE LOADING/UNLOADING AND TRANSPORTATION OF FLOATING LOADS

CROSS-REFERENCE TO RELATED APPLICATION

This application claims priority to French Patent Application No. 0314642 filed on Dec. 12, 2003, the contents of which are incorporated by reference herein.

FIELD OF THE INVENTION

The present invention relates to the field of the transportation of floating loads, and relates more particularly to a pneumatic boat of the semi-rigid type comprising a rigid hull defined by a rigid underwater hull closed on the top by a rigid floor and bordered at least on two sides by two pneumatic floats.

DESCRIPTION OF THE PRIOR ART

For transporting floating loads such as ships or the like, it is known to have recourse to transportation devices of the "floating-dock" type, which includes ballasts that can, as desired, be filled with water in order to at least partially sink the transportation device and to bring the floating load in line with it (loading) or to move the floating load away from it (unloading), or filled with air in order to make the transportation device float and to cause it to rise up under the floating load in such a way that it can take up said load and move it.

However, such transportation devices are known for handling bulky, heavy floating loads such as ships that cannot be moved by conventional means, and these transportation devices are very sizeable installations.

There is currently no equivalent for handling floating loads of lesser volume and less weight (for example floating tanks, marker buoys, small craft, animals, etc.) without such loads being handled with the aid of on-board cranes, which is a restrictive solution.

SUMMARY OF THE INVENTION

An object of the invention is thus to propose an original solution to the problem posed, with a boat specially fitted out to allow the loading/unloading of a floating load under simple implementation conditions, and even with the aid of less manpower (for example by just one person), this boat itself being of simple design and relatively inexpensive to manufacture.

To these ends, a pneumatic boat as mentioned in the preamble is characterized, being arranged in accordance with the invention, in that it comprises:

- a ballast arranged in the rear part of the inner volume of the rigid hull;
- pumping means for filling said ballast with water or for emptying it thereof;
- two pneumatic chambers defined in the respective rear parts of the two floats, these two chambers being pneumatically isolated from the rest of said floats;
- means for inflating said rear chambers; and
- means for deflating said rear chambers;
- said boat having no rear board.

By virtue of this simple arrangement, the boat is able to occupy two operating positions, namely:

- a position for loading or unloading a floating load, which position is obtained by filling the ballast with water with the aid of the pumping means and by deflating the two rear chambers with the aid of the deflating means, the boat then occupying a marked nose-up position with its rear part submerged beneath the surface of the water such that a floating load can be brought into contact with the floor (loading) or be moved away therefrom (unloading); and
- a navigation position obtained, starting from the above-mentioned loading position, by emptying the ballast of its water with the aid of the pumping means and by inflating the two rear chambers with the aid of the inflating means, the boat changing from the above-mentioned loading position to said navigation position by raising the load brought into contact with its floor.

Thus, by virtue of the arrangements in accordance with the invention, a simple boat is constructed, said boat not having a motor (no rear board) and designed to be towed ("sled" boat), which, owing to the marked nose-up and partially submerged position that it is able to occupy, can be loaded very easily, as the floating load is brought closer to and held against the floor of the boat while the latter is set afloat.

Furthermore, owing to its very concept, a boat of this type may be designed on the basis of existing semi-rigid-type pneumatic boats, from which it can take essential elements: the boat according to the invention may thus be produced at lower cost.

However, bearing in mind some of its basic characteristics, the boat according to the invention may be made to be different by means of specific arrangements. In particular, owing to the absence of a motor, the rigid underwater hull and the floor may be extended towards the rear, substantially as far as the vicinity of the rear ends of the floats to provide a maximum surface area for supporting the load when the latter is on board.

So that the boat can occupy a nose-up, partially submerged position suitable for best facilitating the loading/unloading operation, it is advantageous for the ballast to occupy substantially the rear half of the rigid hull and for the two rear chambers of the floats to preferably have substantially the same length as the ballast. Furthermore, in order for the boat to remain sufficiently buoyant despite the ballast being filled with water and the rear part of the two floats being deflated, it is desirable for the front part of the rigid hull not occupied by the ballast to be filled with a low-density material (buoyant material).

In order to optimize employment of the boat and, as required, to allow the boat to be used asymmetrically, provision may be made for the two rear chambers to have different inflating means and deflating means, respectively.

If the boat is to be multi-purpose, it is advantageous for the floor to be substantially planar at least over its greater part, so that it can receive any type of load. However, if the boat is to be employed for transporting specific loads, the floor may be shaped to suit the shape of the load (central channel, curved floor, etc.).

When the boat, initially partially submerged, is set afloat together with the load the latter overhangs the stern of the boat and has to be moved towards the bows by being slid over the floor. In order to facilitate this operation, it is advantageous for the floor to be at least partially covered with a layer of a material capable of facilitating sliding (in particular, a synthetic material marketed under the TEFLON name). It is also, advantageously, possible to make provision for a winch arranged towards the front of the floor in order to pull a load onto the floor.

In order to free up as much floor surface as possible, provision may be made for a box structure arranged towards the front of the floor, said box structure being capable of supporting a winch with electric drive and of housing batteries for driving said winch and also controls for the pumping means associated with the ballast.

Furthermore, it is advantageous for the inflating means and the deflating means to have their respective controls located at the bows of the boat, in the vicinity of said box structure, such that one person alone, located at the bows and having all the controls within arm's reach, can fully handle the boat.

BRIEF DESCRIPTION OF THE DRAWINGS

The invention will be better understood on reading the following detailed description of a preferred embodiment given solely by way of non-limiting example. In this description, reference is made to the appended drawings, in which.

DETAILED DESCRIPTION OF THE INVENTION

Figure 1:
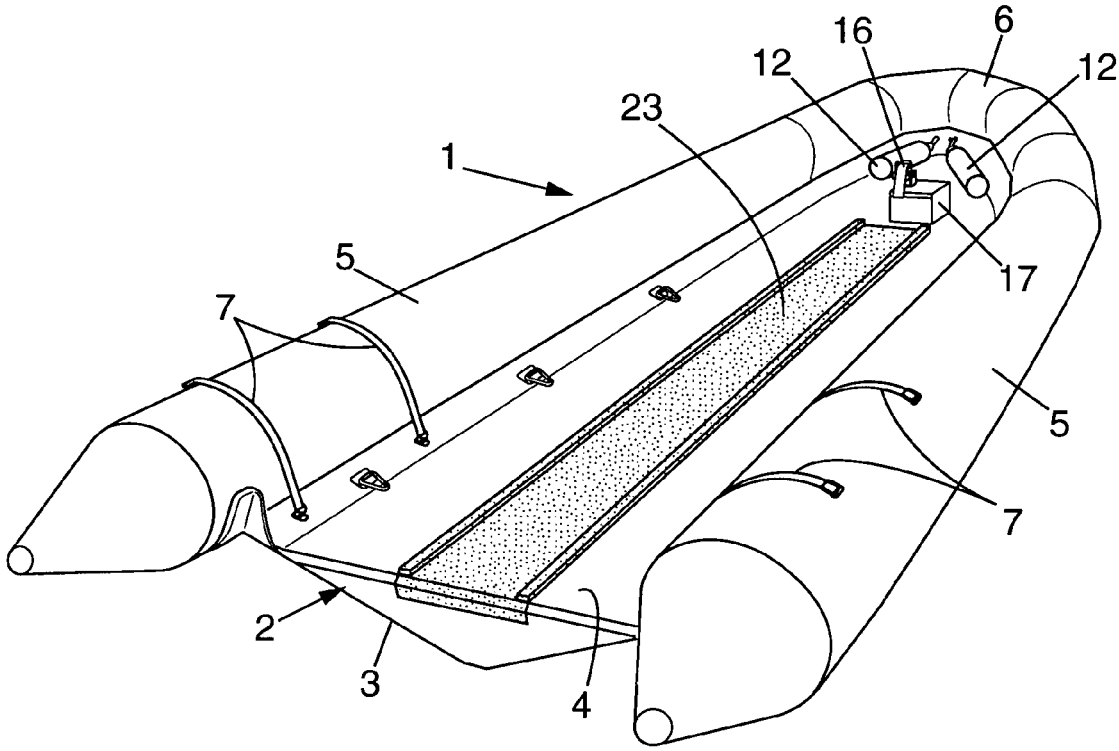
FIG. 1 is an overall view, in three quarters rear perspective, of a pneumatic boat according to the invention.

In the following description, reference will first be made to FIGS. 1 to 4.

The boat according to the invention, for transporting floating loads, is a pneumatic boat of the general type known as a semi-rigid boat 1, which includes a rigid hull 2 defined by a rigid underwater hull 3 closed on the top by a rigid floor 4 and bordered at least on two sides by two pneumatic floats 5. In general, the two floats 5 join up towards the bows at 6, above the stem of the underwater hull.

Unlike a traditional semi-rigid boat, the boat according to the invention has no rear board and thus no motor. Globally, therefore, it takes the form of a simple barge, as may be seen best in FIG. 1. Furthermore, owing to the absence of a motor, the rigid hull may be extended towards the rear substantially as far as the vicinity of the rear ends of the floats 5, such that the floor 4 has a maximum surface area.

The assembly of floats 5 may be fastened to the rigid hull 2 by any means known in this field, either in a definitive, fixed manner (for example, by screw-bolt-joint assembly, adhesive bonding), or in a detachable manner (bead/channel assembly, in particular). If appropriate, particularly in the case of a detachable assembly, for example by means of bead/channel, provision may be made for there to be linking straps 7 between the rear of the floor and the floats 5 in order to make this part of the boat, which is subject to significant forces during loading/unloading of the load, mechanically stronger.

Figure 2:
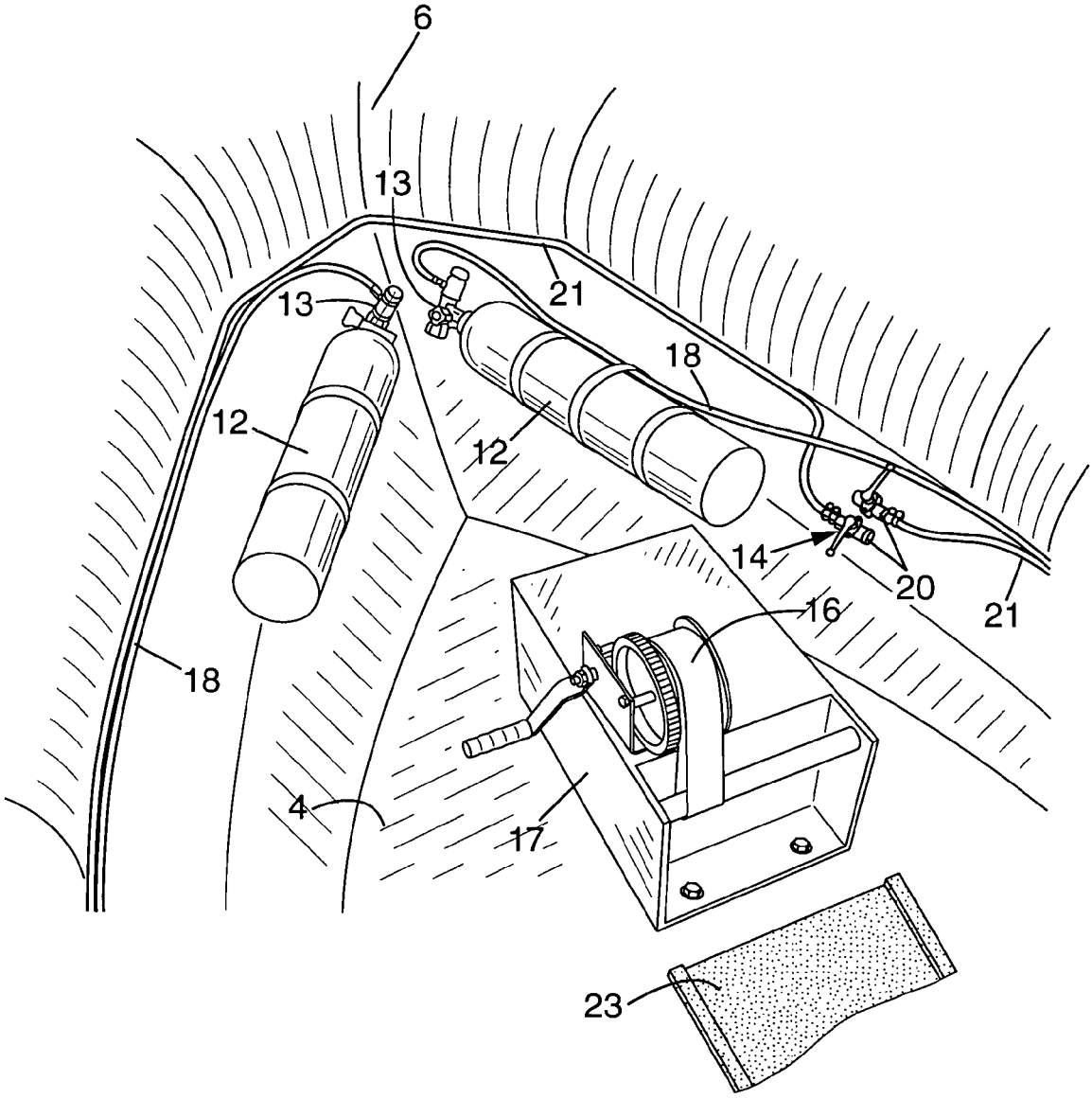
FIG. 2 is a view on a larger scale, in perspective from above, of the front part of the floor of the boat of FIG. 1.
Figure 3:
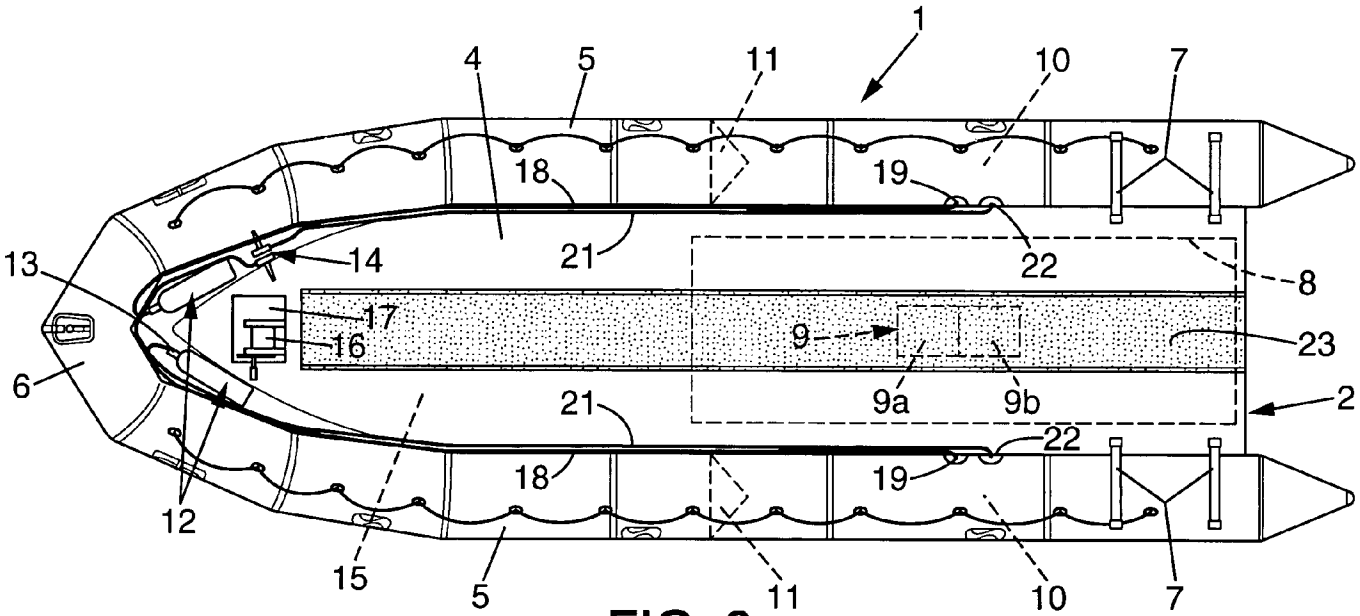
FIG. 3 is a top view of the boat of FIG. 1.

The boat also comprises:

- a reservoir or ballast 8 arranged in the rear part and advantageously in the rear part of the inner volume of the rigid hull 2, as may be seen in FIG. 3;
- pumping means 9 for filling said ballast 8 with water or for emptying it thereof; preferably the pumping means 9 comprise a pump 9*a* for filling with water and a pump 9*b* for discharging water;
- two pneumatic chambers 10 defined in the respective rear parts of the two floats 5, these two chambers 10 being pneumatically isolated (internal partition 11) from the rest of said floats (which may thus be conventionally subdivided into a plurality of compartments connected by intercommunicating valves); preferably, the two pneumatic chambers 10 extend over approximately half the length of the floats 10 and thus correspond approximately with the length of the ballast 8, as may be seen in FIG. 3;
- inflating means 12 connected to the pneumatic chambers 10 in order to inflate the latter, these inflating means 12 comprising, for example, one or more high-pressure air cylinders, as may be seen in FIGS. 1 to 3, the inflating means including control means 13 (in particular, one or more valves) for controlling inflation; and
- deflating means 14 connected to the pneumatic chambers 10 for deflating the latter.

Preferably, the front part 15 of the rigid hull 2 that is not occupied by the ballast 8 is filled with a low-density material (buoyant material) so as to enhance the buoyancy of the bows of the boat.

In order to make the boat more versatile, provision may be made for the two pneumatic chambers 10 to have different inflating means 12 and deflating means 14 respectively.

Furthermore, to facilitate loading of the load into the boat, it is desirable to provide a winch 16 at the front of the floor 4. Preferably, this is a battery-powered electric winch and, if this is the case, a casing or box structure 17 that supports the winch 16 and encloses the batteries and also the controls for the pumping means 9 is arranged at the front of the floor 4, as illustrated in FIGS. 1 to 3.

Lastly, it is possible to group together, at the bows of the boat, all the controls necessary for making use of it, as illustrated clearly, on a larger scale, in FIG. 2. At the front of the floor 4, the inflating means 12 consist of two pressurized gas cylinders each provided with a valve 13 that constitutes the inflation-control means, which valves 13 are connected, by tubes 18 running along the edge of the floor 4, to inflation orifices 19 of the pneumatic chambers 10.

The deflating means 14 consist of two valves 20, which are open to the atmosphere, connected, by tubes 21 running along the edge of the floor 4, to orifices 22 for deflating the pneumatic chambers 10. The two deflation valves 20 are preferably juxtaposed so that they can be actuated practically simultaneously.

Owing to the grouping together of all the controls, as illustrated in FIGS. 2 and 3, a single person located at the bows of the boat can operate all the functions, as will be explained below.

In the example illustrated in the figures, and as may be seen particularly in FIG. 1, the floor 4 is substantially planar at least over its greater part. To facilitate sliding of the load, the floor is at least partially covered with a layer 22 of a material capable of facilitating sliding (for example synthetic material marketed under the TEFLON name). This layer 22, illustrated in the form of a central longitudinal strip in FIGS. 1 and 3, may have any appropriate shape to suit the shape of the load. Similarly, the floor 4 may be adapted to a particular shape of the load and, for example, may include one or more longitudinal channels, be curved, etc.

Lastly, by virtue of the means that characterize the boat according to the invention, this boat is used in the following manner.

Figure 4:
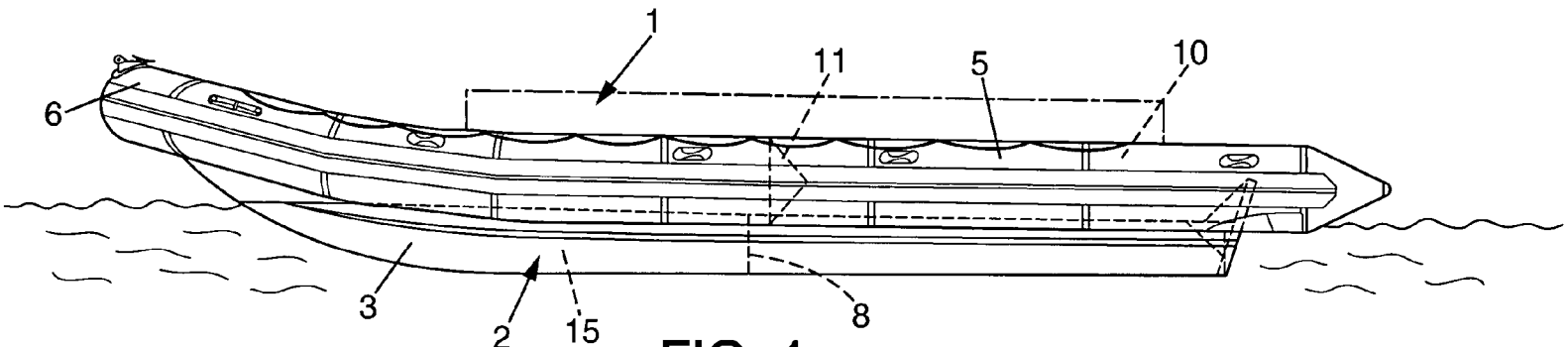
FIG. 4 is a side view of the boat of FIG. 3, in the navigating position.

Under normal conditions, the boat occupies a navigation position, illustrated in FIG. 4, which corresponds to the usual position of a boat of the semi-rigid type. In this situation, the ballast 8 is empty (filled with air), and the rigid hull 2 behaves like a conventional semi-rigid-boat rigid hull, except for the fact that the front part of this hull is filled with low-density material. The rear chambers 10 of the floats 5, meanwhile, are pneumatically inflated to the usual inflation pressure such that the floats 5 overall act like conventional floats. Having no motor, the boat has to be towed in order to move.

Figure 5:
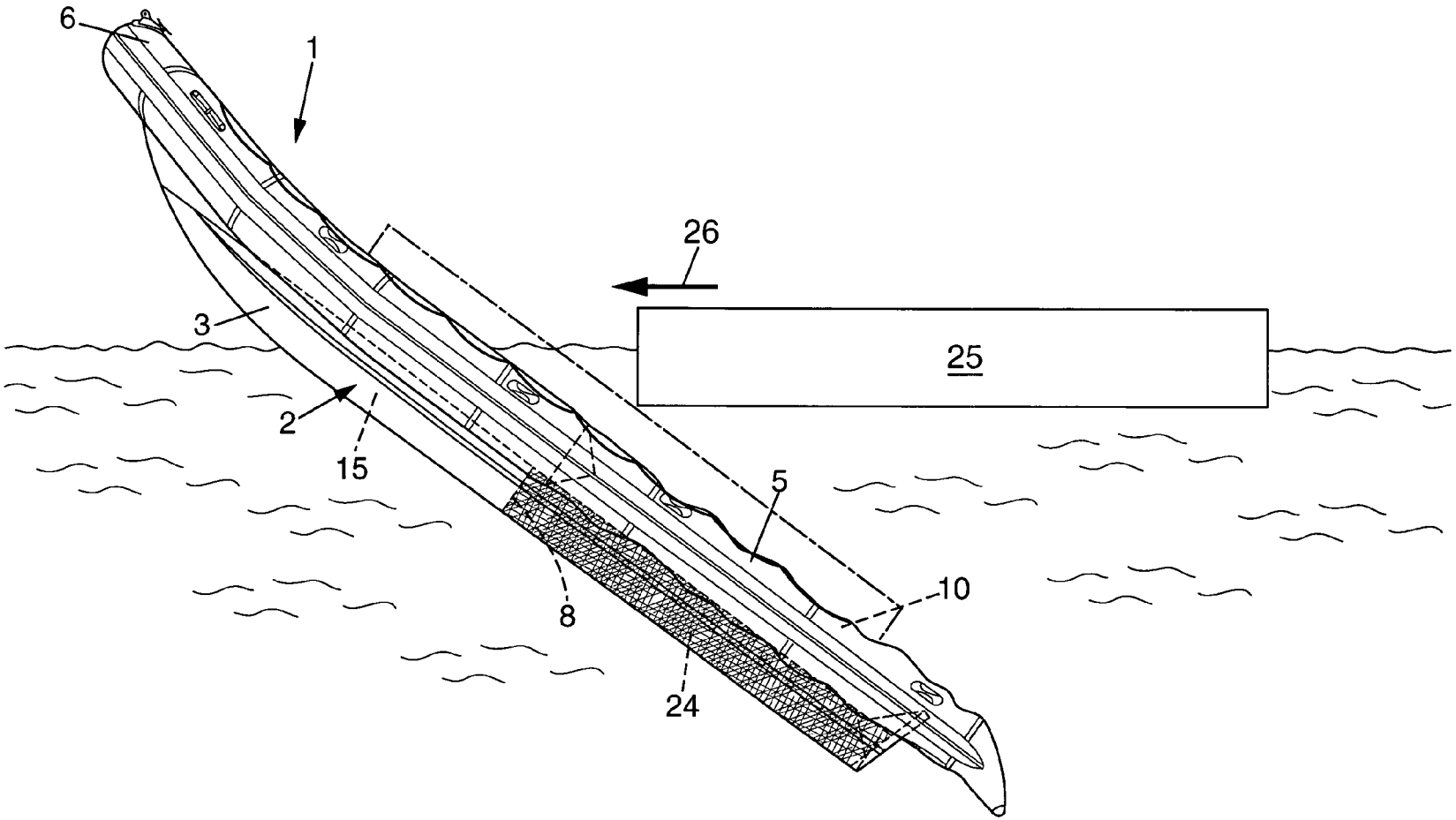
FIG. 5 is a side view of the boat of FIG. 3, in the loading/unloading position, nose up and partially submerged at the rear.

To place a floating load on board, the boat is moved so as to occupy a second position, which is illustrated in FIG. 5. To do this, the ballast 8 is filled with water with the aid of the filling pump 9*a*, whilst the two respective rear chambers 10 of the floats 5 are emptied of pressurized inflation air by the valves 20 of the deflating means 14 being opened. Weighted down by the ballast 8 filled with water 24 (shown diagrammatically as a shaded area in FIG. 5), and having lost its buoyancy at the rear owing to the deflation of the chambers 10, the boat is nose up and also largely submerged at the rear, as illustrated in FIG. 5. Its buoyancy in this position is guaranteed by means of the front part of the floats, which remains inflated, and by the low-density material with which the front part of the hull is filled. The nose-up angle of the boat may typically be as much as 30 to 45°.

With the boat in this partially submerged position, a floating load 25 is brought closer to it (arrow 26) until it comes into contact with the floor 4 and is secured to the cable of the winch 16 so as to remain above the floor and in line with it.

Next, the boat is set afloat. The emptying pump 9*b* is set in operation in order to empty the ballast 8, whilst the valves 13 of the inflating means are opened in order to re-inflate the rear chambers 10. The boat rights itself, pulling in the load 25, which has its weight progressively taken up onto the floor 4. By actuating the winch 16, it is possible to pull the load 25 and to make it slide over the floor 4 (the slide layer 25 facilitating this movement) in order to bring it into a suitable, centred position in the boat, and then the load is stowed. The boat can then be towed in order to move the load 25 along (load shown in dot-dash line in FIG. 4).

The filling 9*a* and emptying 9*b* pumps may advantageously be of the high-flow-rate type: the operations of partially submerging the boat and setting it afloat may then take place very rapidly (for example, over a few seconds).

The grouping-together of all the controls at the bows of the boat enables a single person to carry out all the manoeuvres described above, it being possible for the load 25 itself to be brought closer to the boat either by the person, himself/herself or by an assistant.

Unloading of a floating load 25 may be achieved under the same conditions.

The use of different pneumatic controls for the two rear chambers 10 may make it possible to cause the boat to adopt an asymmetric nose-up position in order to facilitate the placing on board of a load (or the unloading thereof) under special conditions.

What is claimed is:

1. A pneumatic boat of the semi-rigid type, comprising a rigid hull defined by a rigid underwater hull closed on the top by a rigid floor and bordered at least on two sides by two pneumatic floats, comprising:

a ballast arranged in the rear part of the inner volume of the rigid hull;

pumping means for filling said ballast with water or for emptying it thereof;

two pneumatic chambers defined in the respective rear parts of the two floats, these two chambers being pneumatically isolated from the rest of said floats;

means for inflating said rear chambers; and means for deflating said rear chambers;

said boat having no rear board, whereby the boat is able to occupy two operating positions, namely:

a position for loading or unloading a floating load, which position is obtained by filling the ballast with water with the aid of the pumping means and by deflating the two rear chambers with the aid of the deflating means, the boat then occupying a marked nose-up position with its rear part submerged beneath the surface of the water such that a floating load can be brought into contact with the floor (loading) or be moved away therefrom (unloading); and a navigation position obtained, starting from the above-mentioned loading position, by emptying the ballast of its water with the aid of the pumping means and by inflating the two rear chambers with the aid of the inflating means, the boat changing from the above-mentioned loading position to said navigation position by raising the load brought into contact with its floor.

2. A boat according to claim 1, wherein the rigid hull extends, towards the rear, substantially as far as the vicinity of the rear ends of the floats.

3. A boat according to claim 1, wherein the ballast occupies substantially the rear half of the rigid hull.

4. A boat according to claim 1, wherein the front part of the rigid hull not occupied by the ballast is filled with a low-density material.

5. A boat according to claim 1, wherein the two rear chambers of the floats have substantially the same length as the ballast.

6. A boat according to claim 1, wherein provision is made for the two rear chambers to have different inflating means and deflating means, respectively.

7. A boat according to claim 1, wherein the floor is substantially planar at least over its greater part.

8. A boat according to claim 1, wherein the floor is at least partially covered with a layer of a material capable of facilitating the sliding of a load.

9. A boat according to claim 1, wherein provision is made for a winch arranged towards the front of the floor in order to pull a load onto the floor.

10. A boat according to claim 1, wherein provision is made for a box structure arranged towards the front of the floor, said box structure being capable of supporting a winch with electric drive and of housing batteries for driving said winch and also controls for the pumping means associated with the ballast.

11. A boat according to claim 10, wherein the inflating means and deflating means have their respective controls located at the bows of the boat, in the vicinity of said box structure.

* * * * *